US006015004A

United States Patent [19]

Harkinson

[11] Patent Number: 6,015,004

[45] Date of Patent: Jan. 18, 2000

[54] FABRIC SUPPORTING RING FIXTURES FOR CREATING BED CANOPY AND WINDOW DRAPERY ARRANGEMENTS

[76] Inventor: Greg Harkinson, 12121 Veterans Memorial Dr., Ste. 2, Houston, Tex. 77067

[21] Appl. No.: 09/087,310

[22] Filed: May 29, 1998

[51] Int. Cl.[7] ..... A47H 19/00

[52] U.S. Cl. ..... 160/349.1; 160/348; 211/87.01; 211/106; 5/414

[58] Field of Search ..... 160/348, 349.1, 160/349.2, 330, 123, 124; 211/87.01, 106; 248/315; D6/546, 548, 578, 579, 580; 5/414, 493

[56] References Cited

U.S. PATENT DOCUMENTS

| | | | |
|---|---|---|---|
| D. 367,578 | 3/1996 | Locke | D6/575 |
| 2,236,017 | 3/1941 | Stratton | 160/349.2 X |
| 2,244,129 | 6/1941 | Stratton | 160/349.2 X |
| 2,316,337 | 4/1943 | Kenney | 160/349.2 X |
| 2,329,446 | 9/1943 | Whitehead et al. | 160/349.2 |
| 2,337,950 | 12/1943 | Werner et al. | 160/349.2 X |
| 2,430,238 | 11/1947 | Moorefield | 248/315 |
| 2,431,934 | 12/1947 | Higgins | 160/349.2 |
| 2,470,233 | 5/1949 | Boye | 160/349.2 |
| 2,990,066 | 6/1961 | Arnett | 211/106 |
| 5,141,045 | 8/1992 | Williams | 160/348 |
| 5,307,860 | 5/1994 | Wilkinson et al. | 160/348 |
| 5,323,996 | 6/1994 | Rendall | 248/315 |
| 5,775,401 | 7/1998 | Faurie | 160/349.2 |

*Primary Examiner*—David M. Purol
*Attorney, Agent, or Firm*—Kenneth A. Roddy

[57] ABSTRACT

Fabric supporting ring fixtures for use in creating bed canopy and window drapery arrangements. A corner ring fixture has a central body portion configured to be supported in a first plane from a support surface and a pair of fabric receiving ring elements each having an outer circumferential portion extending outwardly from the central body portion in a second plane different from the first plane. An intermediate ring fixture has a central body portion configured to be supported from a support surface and a fabric receiving ring element with an outer circumferential portion extending perpendicularly outward therefrom. The fabric receiving ring elements have a central circular opening sized to pass fabric and drapery materials therethrough and to support the fabric and drapery materials in decorative arrangements. Typically, the corner ring fixtures are installed on a flat surface above a bed or window in spaced apart relation and allow a length of fabric material to be passed through its ring elements to selectively make a transition from a first horizontal plane to a second horizontal plane angularly offset therefrom or to make a transition from a horizontal plane to a vertical plane, and the intermediate ring fixtures are installed on a flat surface between the spaced apart corner ring fixtures to support lengths of fabric material passed through the corner ring fixtures.

9 Claims, 6 Drawing Sheets

FABRIC SUPPORTING RING FIXTURES FOR CREATING BED CANOPY AND WINDOW DRAPERY ARRANGEMENTS

BACKGROUND OF THE INVENTION

1. Field of the Invention

This invention relates generally to fixtures and devices for supporting and positioning fabric, drapery, and bed canopy materials, and more particularly to ring fixtures that are attached to vertical or horizontal surfaces and have outwardly extending rings to support lengths of fabric to form decorative bed canopy and window drapery arrangements.

2. Brief Description of the Prior Art

There are several patents which disclose various fixtures and devices for supporting and positioning drapery fabrics and valances for canopy beds.

Gilley et al, U.S. Pat. Nos. 5,282,505, 5,377,740, and 5,392,839 disclose a multipurpose window treatment support device for supporting various lengths, sizes and types of curtain and drapery material in a variety of different decorative treatment arrangements. The device comprises an elongated thin flat holder containing a number of openings of different sizes and shapes along its length with an elongate rod extending across its lower portion. The holders are vertically mounted in front of an area to be decorated and looped sections of material are passed from its back to its front through one or more of the openings or looped over the rod after which the looped sections are fluffed out or draped in front of the holder.

Hansen et al, U.S. Pat. No. 4,785,837 discloses a ceiling suspended bed canopy comprising frame formed of rigid material which may be bent to an arched position suspended from the ceiling by lines and over which a conventional fabric canopy cover is removably received.

Denney, U.S. Pat. No. 4,729,137 discloses a bed canopy support and assembly comprising four supports fastened together in a rectangular configuration, each having a channel-shaped valance support member and an L-shaped drapery and canopy support member projecting downwardly from the valance support member. Hook and loop fasteners are provided on each support for attaching a valance drapery and canopy to the support.

Steel, U.S. Pat. No. 4,414,727 discloses a kit for converting a bed into a four-poster including pelments that are secured to the ceiling above the sides and ends of the bed and corner posts pivotally connected with the pelments which are positioned at the four corners of the bed.

McMullen, U.S. Pat. No. 4,295,482 discloses a valance support for a canopy bed comprising ceiling mounted supports with first and second flat side portions disposed at substantially right angles to one another. The supports are secured to the ceiling above the four corners of a bed and elastic cords are stretched between the first and second sides of the supports. Corner draperies are suspended from the supports by drapery hooks hooked in apertures in the side portions. A canopy is secured to the supports by brackets, and an outside ruffle disposed around the peripheral edges of the bed is attached to the elastic cords by drapery hooks.

The present invention is distinguished over the prior art in general, and these patents in particular by fabric supporting ring fixtures that are used to create decorative bed canopy and window drapery arrangements. A corner ring fixture has a central body portion configured to be supported in a first plane from a support surface and a pair of fabric receiving ring elements each having an outer circumferential portion extending outwardly from the central body portion in a second plane different from the first plane. An intermediate ring fixture has a central body portion configured to be supported from a support surface and a fabric receiving ring element with an outer circumferential portion extending perpendicularly outward therefrom. The fabric receiving ring elements have a central circular opening sized to pass fabric and drapery materials therethrough and to support the fabric and drapery materials in decorative arrangements. Typically, the corner ring fixtures are installed on a flat surface above a bed or window in spaced apart relation and allow a length of fabric material to be passed through its ring elements to selectively make a transition from a first horizontal plane to a second horizontal plane angularly offset therefrom or to make a transition from a horizontal plane to a vertical plane, and the intermediate ring fixtures are installed on a flat surface between the spaced apart corner ring fixtures to support lengths of fabric material passed through the corner ring fixtures.

SUMMARY OF THE INVENTION

It is therefore an object of the present invention to provide a set of fabric supporting ring fixtures that are used to create various decorative bed canopy and window drapery arrangements.

It is another object of this invention to provide a set of fabric supporting ring fixtures that can be easily and quickly installed on the ceiling or wall above a bed or window without the use of special tools.

Another object of this invention is to provide a kit of materials containing a set of fabric supporting ring fixtures that allow the purchaser to easily create various decorative bed canopy and window drapery arrangements simply using lengths of fabric material.

Another object of this invention is to provide a set of fabric supporting ring fixtures having corner ring elements that allow lengths of fabric material to be passed through the ring elements to selectively make a transition from a first horizontal plane to a second horizontal plane angularly offset therefrom or to make a transition from a horizontal plane to a vertical plane, and intermediate ring elements to support lengths of fabric material passed through the corner ring elements.

A further object of this invention is to provide a set of fabric supporting ring fixtures having ring elements that allow lengths of fabric material to be passed through the ring elements to make ornamental swags, rosettes, and bows to create decorative effects and hide the fixtures from view.

A still further object of this invention is to provide a set of fabric supporting ring fixtures that are simple in design, inexpensive to manufacture, and aesthetically pleasing.

Other objects of the invention will become apparent from time to time throughout the specification and claims as hereinafter related.

The above noted objects and other objects of the invention are accomplished by the present fabric supporting ring fixtures that are used to create decorative bed canopy and window drapery arrangements. A corner ring fixture has a central body portion configured to be supported in a first plane from a support surface and a pair of fabric receiving ring elements each having an outer circumferential portion extending outwardly from the central body portion in a second plane different from the first plane. An intermediate ring fixture has a central body portion configured to be supported from a support surface and a fabric receiving ring element with an outer circumferential portion extending perpendicularly outward therefrom. The fabric receiving ring elements have a central circular opening sized to pass fabric and drapery materials therethrough and to support the fabric and drapery materials in decorative arrangements. Typically, the corner ring fixtures are installed on a flat surface above a bed or window in spaced apart relation and allow a length of fabric material to be passed through its ring elements to selectively make a transition from a first horizontal plane to a second horizontal plane angularly offset therefrom or to make a transition from a horizontal plane to a vertical plane, and the intermediate ring fixtures are installed on a flat surface between the spaced apart corner ring fixtures to support lengths of fabric material passed through the corner ring fixtures.

DESCRIPTION OF THE PREFERRED EMBODIMENT

Figure 1:
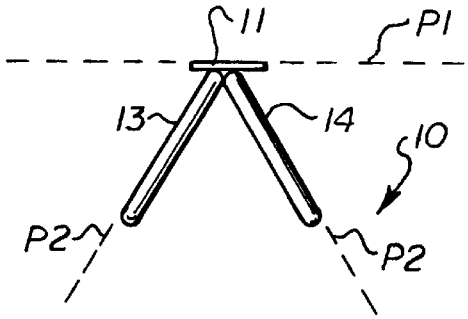
FIG. 1 is a top plan view of a fabric supporting corner ring fixture having a generally rectangular mounting plate in accordance with a first embodiment of the present invention.
Figure 2:
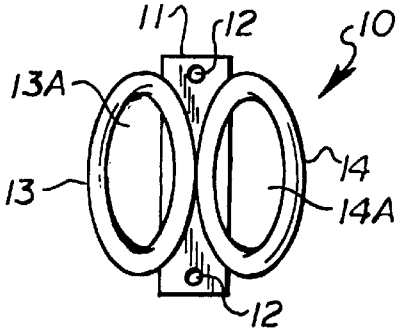
FIGS. 2 and 3 are front and rear elevation views, respectively, of the first embodiment of the corner ring fixture.
Figure 3:
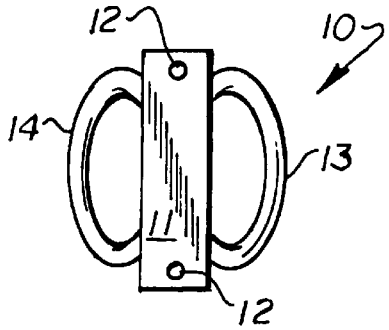
Figure 4:
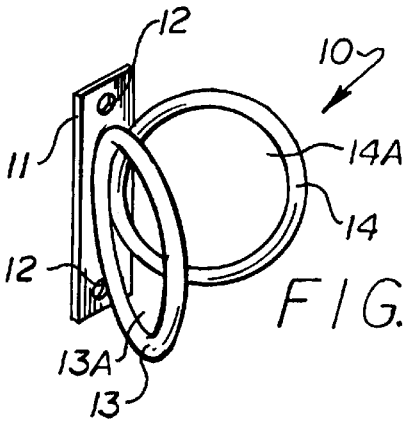
FIG. 4 is a perspective view of the first embodiment of the corner ring fixture.

Referring to the drawings by numerals of reference, there is shown in FIGS. 1, 2, 3 and 4, a first embodiment of a fabric supporting corner ring fixture 10 in accordance with the present invention. The fabric supporting corner ring fixture 10 has a central body portion in the form of a flat rectangular mounting flange or plate 11 with apertures 12 extending therethrough near its opposed ends for receiving screws or other suitable fasteners.

A first fabric receiving ring 13 and second fabric receiving ring 14 are secured to the mounting flange or plate 11 along a portion of their outer circumference and their remaining circumferential portions diverge outwardly therefrom in angularly opposed relation. The fabric receiving rings 13 and 14 each have a central circular opening 13A and 14A, respectively, sized to pass fabric and drapery materials therethrough and to support the fabric and drapery materials in decorative arrangements, as described hereinafter.

In the illustrated example, the fabric receiving rings 13 and 14 are disposed so as to define an angle of approximately 600 between them. However, it should be understood that the rings 13 and 14 may diverge outwardly from the central body portion 11 at approximately 45° or any other suitable angle, depending upon the particular application and desired decorative effect to be achieved.

As shown in FIG. 1, the mounting flange or plate 11 lies in a first plane P1 when secured to a flat support surface and the outwardly diverging portions of the rings 13 and 14 lie in a second plane P2 which is angularly offset from the first plane.

The embodiment depicted in FIGS. 1–4 may be secured by means of conventional commercially available fasteners, such as wood screws or molybolts, etc., to a vertical surface such as a wall or window frame with its mounting plate 11 positioned vertically, or it may be secured to a horizontal surface, such as a ceiling over a bed or window with its mounting plate positioned horizontally.

FIGS. 5, 6, 7 and 8 show a second embodiment of a fabric supporting corner ring fixture 15 in accordance with the present invention. In this modification, the corner fixture 15 has a central body portion in the form of a toroid or circular support ring 16.

A first fabric receiving ring 17 and second fabric receiving ring 18 are secured to the support ring 16 along a portion of their outer circumference and their remaining circumferential portions diverge outwardly therefrom in angularly opposed relation. The fabric receiving rings 17 and 18 each have a central circular opening 17A and 18A, respectively, sized to pass fabric and drapery materials therethrough and to support the fabric and drapery materials in decorative arrangements, as described hereinafter.

In the illustrated example, the fabric receiving rings 17 and 18 are disposed so as to define an angle of approximately 60° between them. However, it should be understood that the rings 17 and 18 may diverge outwardly from the circular support ring 16 at approximately 45° or any other suitable angle, depending upon the particular application and desired decorative effect to be achieved.

Figure 8:
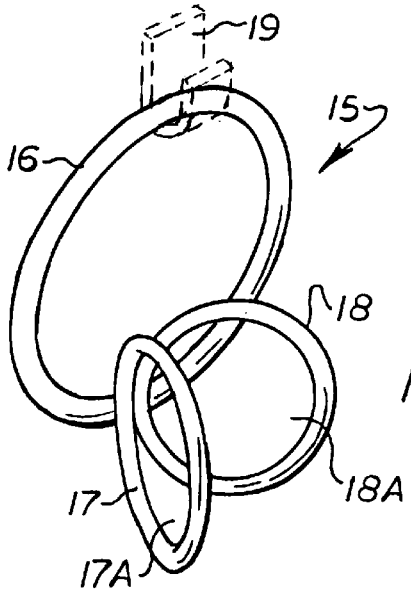
FIG. 8 is a perspective view of the second embodiment of the corner ring fixture.

As shown in dashed line in FIG. 8, the circular support ring 16 may be suspended from a J-shaped or U-shaped hook portion 19 of a conventional commercially available curtain rod hook bracket, hanging plant bracket, hanging lamp fixture hook, etc., which is secured to a vertical surface such as a wall or window frame or to a horizontal surface, such as a ceiling over a bed or window with the circular support ring 16 positioned vertically.

Figure 5:
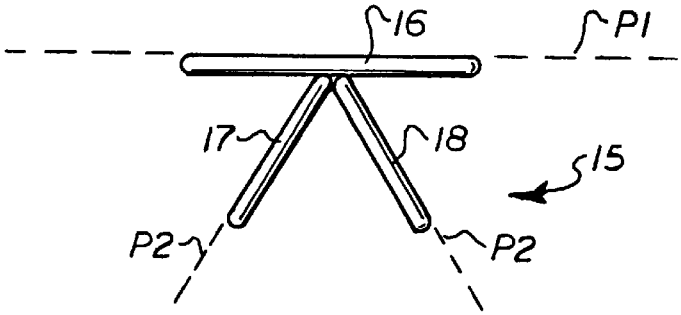
FIG. 5 is a top plan view of a fabric supporting corner ring fixture having a circular support ring in accordance with a second embodiment of the present invention.
Figure 6:
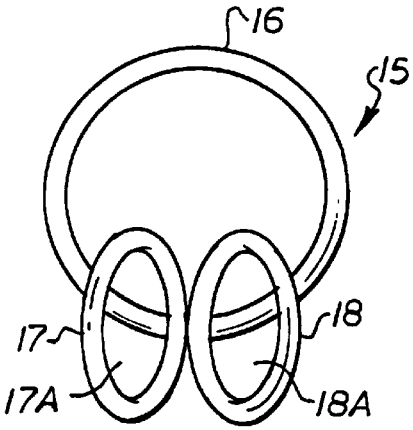
FIGS. 6 and 7 are front and rear elevation views, respectively, of the second embodiment of the corner ring fixture.
Figure 7:
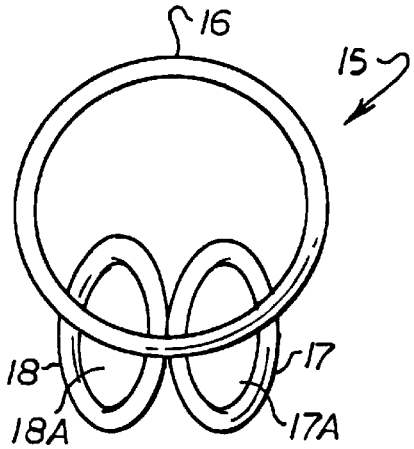

As shown in FIG. 5, the circular support ring 16 lies in a first plane P1 when supported from a flat support surface and the outwardly diverging portions of the rings 17 and 18 lie in a second plane P2 which is angularly offset from the first plane.

Figure 9:
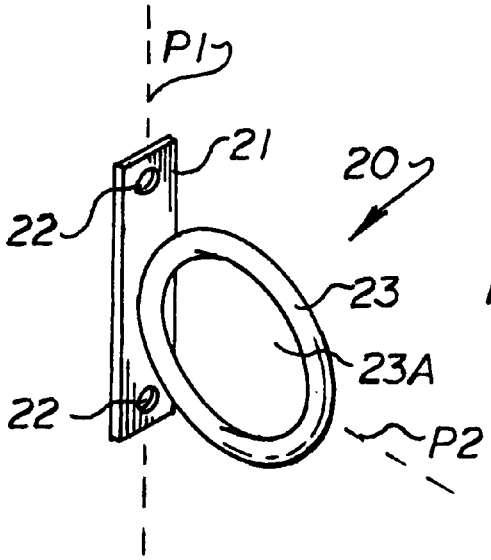
FIG. 9 is a perspective view of an intermediate fabric supporting ring fixture in accordance with the present invention, shown from the front, top and one side.
Figure 10:
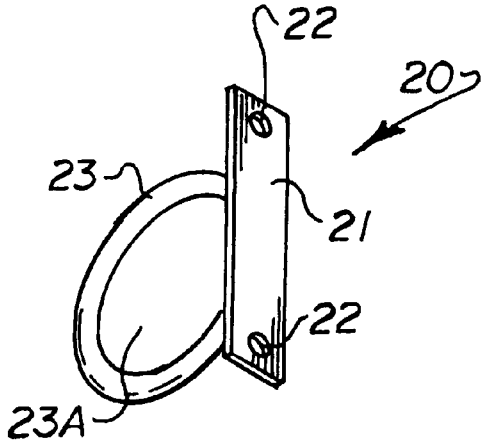
FIG. 10 is a perspective view of the intermediate fabric supporting ring fixture shown from the rear, bottom and the side opposite that shown in FIG. 9.

FIGS. 9 and 10, show a fabric supporting intermediate ring fixture 20 in accordance with the present invention. The fabric supporting intermediate ring fixture 20 has a central body portion in the form of a flat rectangular mounting plate 21 with apertures 22 extending therethrough near its opposed ends for receiving screws or other suitable fasteners.

A fabric receiving ring 23 is secured to the mounting plate 21 along a portion of its outer circumference and its remaining circumferential portion extends outwardly therefrom. The fabric receiving ring 23 has a central circular opening 23A sized to pass fabric and drapery materials therethrough and to support the fabric and drapery materials in decorative arrangements, as described hereinafter. In the illustrated example, the fabric receiving ring 23 is disposed perpendicular to the mounting plate 21 so as to define an angle of approximately 90° between them.

As shown in FIG. 9, the mounting plate 21 lies in a first plane P1 when secured to a flat support surface and the outwardly diverging portion of the ring 23 lies in a second plane P2 which is perpendicular to the first plane.

The intermediate ring fixture 20 depicted in FIGS. 9 and 10 may be secured by means of conventional commercially available fasteners, such as wood screws or molybolts, etc., to a vertical surface such as a wall or window frame with its mounting plate 21 positioned vertically, or it may be secured to a horizontal surface, such as a ceiling over a bed or window with its mounting plate positioned horizontally. In a typical installation, one or more of the intermediate ring fixtures 20 are disposed between two spaced apart corner ring fixtures 10 or 15 with their fabric receiving ring elements 23 generally aligned with the fabric receiving ring elements 13–14 or 17–18 of the corner ring fixtures.

In a preferred embodiment, the mounting plate 11 or 21, the support ring 16, and the ring elements 13, 14, 17, 18 and 23 are formed of metal and the ring elements are secured to the mounting plate or support ring by welding. However, it should be understood that the mounting plate 11 or 21, support ring 16, and the ring elements 13, 14, 17, 18, and 23 may be formed of plastic or any other suitable materials and the ring elements may be secured to the mounting plate or support ring by any conventional fastening means such as epoxy, cement, or sonic welding.

Although the mounting flanges or plates 11 and 21 have been shown by way of example in FIGS. 1–4, 9 and 10 as flat rectangular members, it should be understood that the central body portion 11 and 21 of the fixtures 10 and 20 may be formed of various other ornamental shapes, such as ovals shapes, leaf shapes, flower shapes, butterfly wings, scroll patterns, etc.

As described hereinafter, the corner ring fixture embodiments 10 and 15 of FIGS. 1–4 and 5–8 having angularly diverging fabric receiving rings 13,14 and 17,18, respectively are particularly suited for use in supporting fabrics at a point of transition from a first horizontal plane to a second horizontal plane angularly offset from the first plane, and at a point of transition from a horizontal plane to a vertical plane such as forming a bed canopy or for use in a corner or an end location in a window arrangement.

Figure 11:
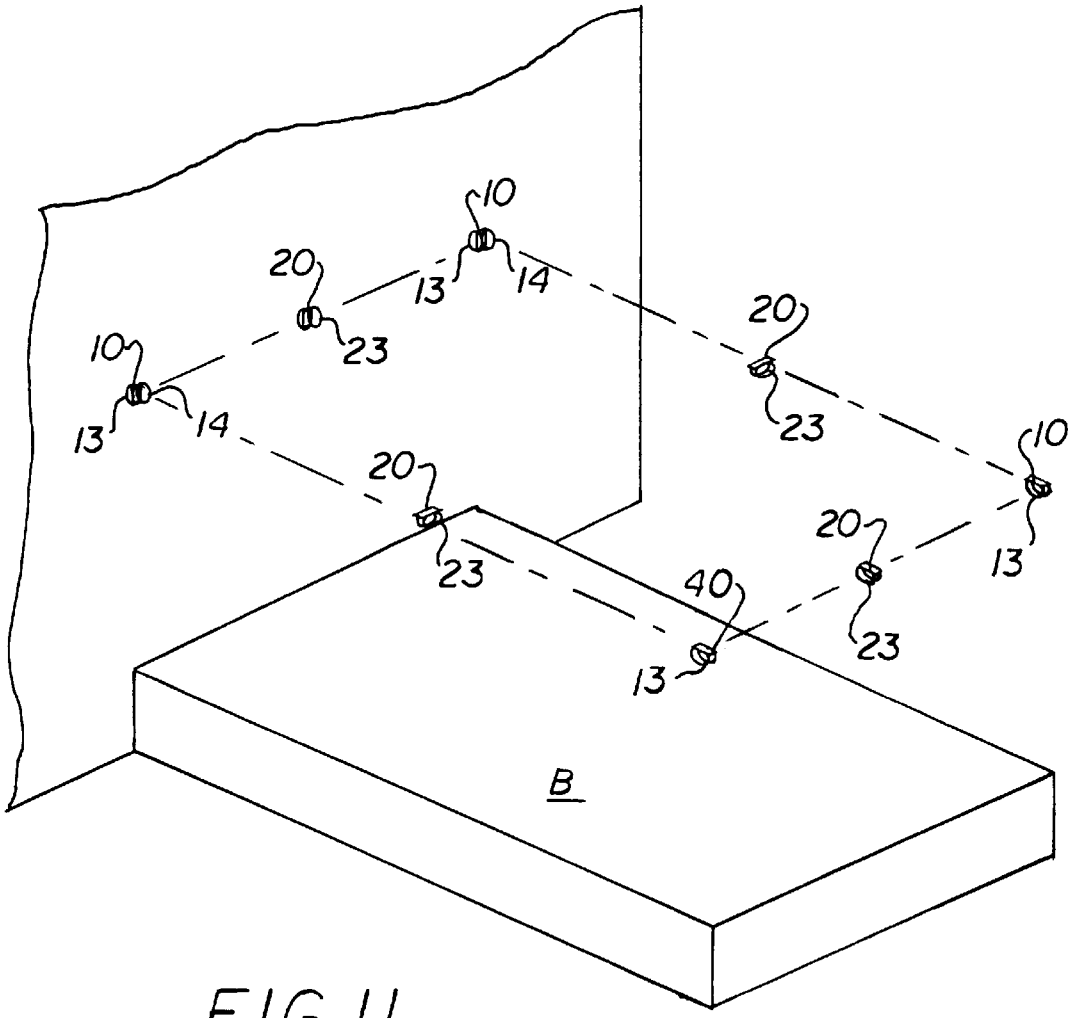
FIGS. 11 and 12 are schematic illustrations showing how the fabric supporting ring fixtures may be used to create a canopy over a bed.
Figure 12:
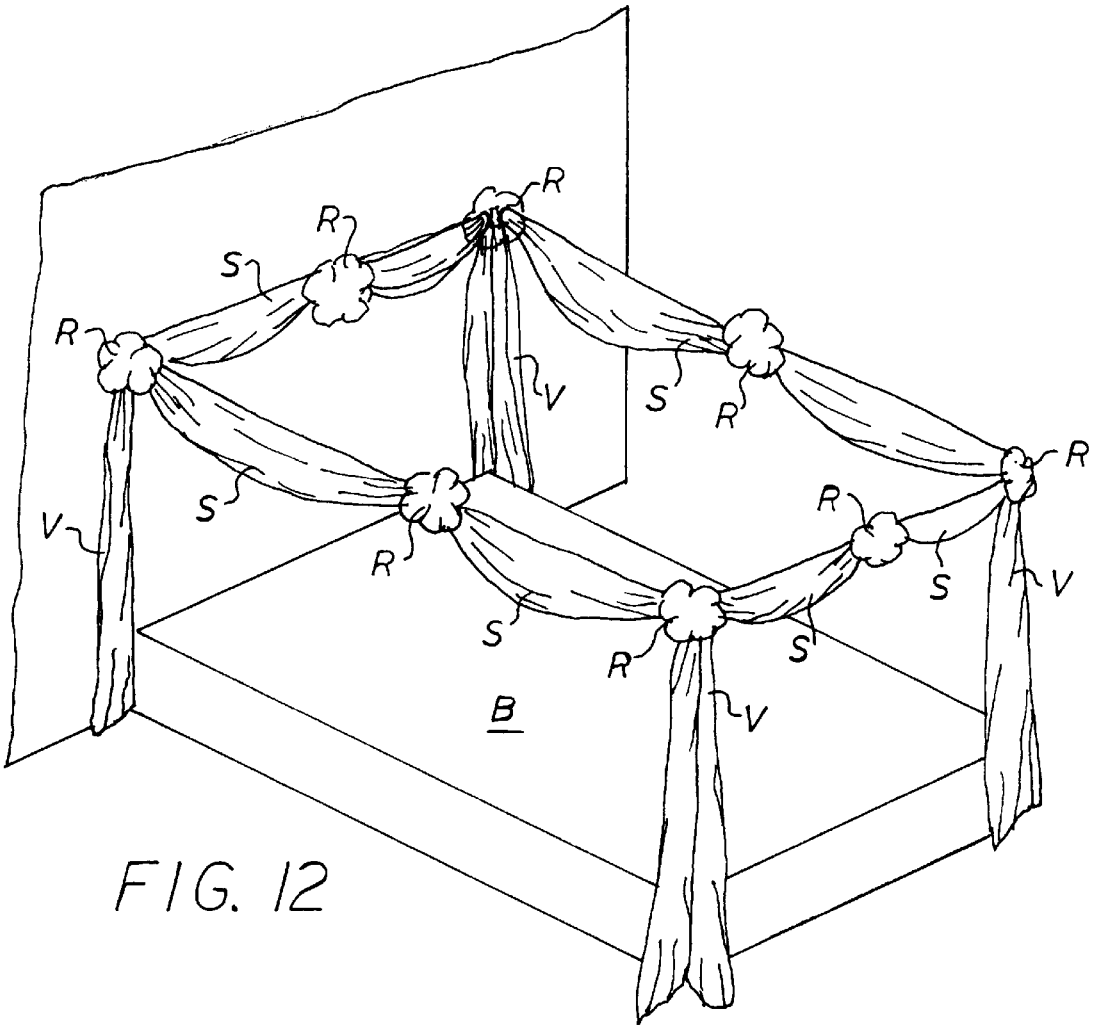

FIGS. 11 and 12 show somewhat schematically, a bed B in a bedroom wherein two of the corner ring fixtures 10 are secured to the wall of the room above the corners of the head of the bed and two are secured to the ceiling above the corners of the foot of the bed with an intermediate ring fixture 21 secured to the wall and ceiling between the corner fixtures with their fabric receiving ring elements 23 generally aligned with the fabric receiving ring elements 13–14 of the corner ring fixtures.

A bed canopy is formed by passing a length of fabric material horizontally through the ring element 23 of the intermediate ring fixture 20 and one or both of the ring elements 13–14 of the two corner ring fixtures above the foot of the bed B and allowing the ends of the fabric material to hang vertically therefrom "V", and passing a second length of fabric material horizontally through the ring element 23 of the intermediate ring fixture 20 and one or both of the ring elements 13–14 of the two corner ring fixtures above the head of the bed and allowing the ends of the fabric material to hang vertically therefrom. A third and fourth length of fabric material is passed horizontally through the ring element 23 of the intermediate ring fixture 20 above the longitudinal sides of the bed B and one or both of the ring elements 13–14 of the corner ring fixtures above the corners of the bed allowing the ends of the fabric material to hang vertically therefrom closely adjacent to the previously installed vertical portions V. The fabric material may be looped around the ring elements while passing it therethrough to further secure it in place.

After the fabric has been installed, the horizontal portions may be draped or fluffed up to form an ornamental "swag" S between the spaced apart ring fixtures. A decorative bow or rosette R may be formed at the corner ring fixtures and at the intermediate ring fixtures, by tying a length of fabric material through the ring elements 13–14 and 23 and then fluffing it up to substantially cover and hide the ring fixtures from view.

Figure 13:
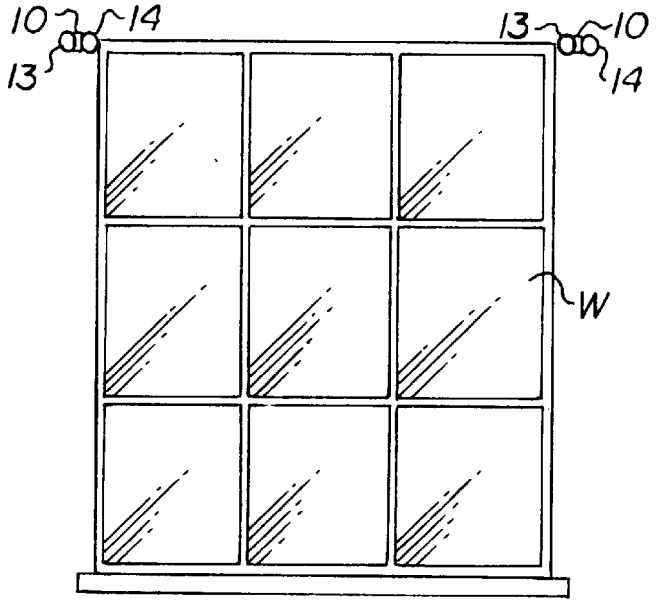
FIGS. 13 and 14 are schematic illustrations showing how the fabric supporting ring fixtures may be used to create a drapery arrangement around a window.
Figure 14:
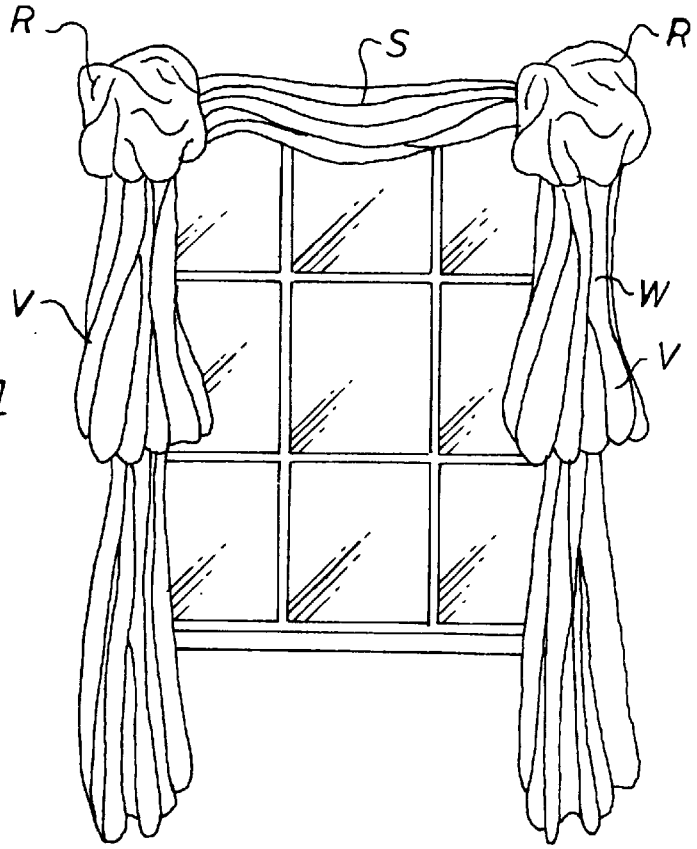

FIGS. 13 and 14 show somewhat schematically, a window drapery arrangement wherein two of the corner ring fixtures 10 are secured to the window frame or wall adjacent to the top corners of a window W with their ring elements 13–14 aligned horizontally. A length of fabric material is passed horizontally through one or both of the ring elements 13–14 of the two corner ring fixtures and the free ends of the fabric material are allowed to hang vertically therefrom V at the sides of the window. Additional lengths of fabric material may also be passed through one or both of the ring elements 13–14 of the two corner ring fixtures to hang vertically therefrom. The fabric material may be looped around the ring elements while passing it therethrough to further secure it in place.

After the fabric has been installed, the horizontal portions may be draped or fluffed up to form an ornamental "swag" S between the spaced apart ring fixtures. A decorative bow or rosette R may be formed at the corner ring fixtures by tying a length of fabric material through the ring elements 13–14 and then fluffing it up to substantially cover and hide the ring fixtures from view. On wider window frames one or more of the intermediate ring fixtures 20 may be installed between the corner fixtures to form adjacent swags above the window (not shown).

While this invention has been described fully and completely with special emphasis upon preferred embodiments, it should be understood that within the scope of the appended claims the invention may be practiced otherwise than as specifically described herein.

I claim:

1. A fabric supporting ring fixture for creating bed canopy and window drapery arrangements, comprising:

a generally flat rectangular mounting plate having front and back surfaces with mounting holes therethrough for receiving fasteners to secure said flat rectangular plate to a flat support surface in a first plane parallel with said support surface;

at least one circular ring element having an outer circumferential portion immovably fixed substantially tangent to said mounting plate front surface and a remaining circumferential portion extending outwardly from said mounting plate front surface alone a second plane generally perpendicular to said first plane; and said at least one ring element having a central circular opening sized to pass fabric and drapery materials therethrough and to support portions of said fabric and drapery materials closely adjacent to said flat support surface in decorative arrangements.

2. The fixture according to claim 1, wherein said remaining circumferential portion of said at least one ring element extends outwardly from said mounting plate perpendicular to said first plane.

3. The fixture according to claim 1, wherein said at least one ring element comprises a first ring element and a second ring element having outer circumferential portions immovably fixed substantially tangent to said mounting plate front surface and remaining circumferential portions extending outwardly from said mounting plate front surface along a second plane generally perpendicular to said first plane, and each having a central circular opening sized to pass fabric and drapery materials therethrough and to support portions of said fabric and drapery materials closely adjacent to said support surface in decorative arrangements.

4. The fixture according to claim 1, wherein said at least one ring element comprises a first ring element and a second ring element having outer circumferential portions immovably fixed substantially tangent to said mounting plate front surface and remaining circumferential portions diverging angularly outward from said mounting plate front surface in angularly opposed relation with respect to said second plane, and each having a central circular opening sized to pass fabric and drapery materials therethrough and to support portions of said fabric and drapery materials closely adjacent to said flat support surface in decorative arrangements.

5. A fabric supporting ring fixture for creating bed canopy and window drapery arrangements, comprising:

a circular support ring adapted to be supported from a flat support surface in a first plane generally parallel to said flat support surface;

at least one circular fabric receiving ring element having an outer circumferential portion immovably fixed substantially tangent to said support ring and a remaining circumferential portion extending outwardly from said support ring along a second plane generally perpendicular to said first plane; and said at least one fabric receiving ring element having a central circular opening sized to pass fabric and drapery materials therethrough and to support portions of said fabric and drapery materials closely adjacent to said flat support surface in decorative arrangements.

6. The fixture according to claim 5, wherein said remaining circumferential portion of said at least one fabric receiving ring element extends outwardly from said support ring perpendicular to said first plane.

7. The fixture according to claim 5, wherein said at least one fabric receiving ring element comprises a pair of fabric receiving ring elements, each having a circumferential portion immovably fixed substantially tangent to said support ring and a remaining circumferential portion extending outwardly from said support ring along a second plane generally perpendicular to said first plane, and each having a central circular opening sized to pass fabric and drapery materials therethrough and to support portions of said fabric and drapery materials closely adjacent to said flat support surface in decorative arrangements.

8. The fixture according to claim 7, wherein said remaining circumferential portions of said pair of fabric receiving ring elements diverge angularly outwardly from said support ring in angularly opposed relation with respect to said second plane.

9. A kit for supporting fabric materials to create bed canopy and window drapery arrangements, comprising in combination;

at least one pair of corner ring fixtures, each corner ring fixture having a central body portion configured to be supported from a support surface in a first plane generally parallel to said support surface and a pair of fabric receiving ring elements each having an outer circumferential portion immovably fixed substantially tangent to said central body portion and a remaining circumferential portion diverging angularly outwardly from said central body portion in angularly opposed relation with respect to a second plane generally Perpendicular to said first plane;

at least one pair of intermediate ring fixtures, each intermediate ring fixture having a generally flat rectangular mounting plate having front and back surfaces with mounting holes therethrough for receiving fasteners to secure said mounting plate to a flat support surface in a plane parallel with said support surface and a fabric receiving ring element having an outer circumferential portion immovably fixed to said mounting plate front surface and a remaining circumferential portion extending perpendicularly outward from said front surface; and said fabric receiving ring elements having a central circular opening sized to pass fabric and drapery materials therethrough and to support portions of said fabric and drapery materials closely adjacent to said support surface in decorative arrangements; wherein said corner ring fixtures are installed on a flat surface above a bed or window in spaced apart relation and allow a length of fabric material to be passed through their said ring elements to selectively make a transition from a first horizontal plane to a second horizontal plane angularly offset therefrom or to make a transition from a horizontal plane to a vertical plane; and said intermediate ring fixtures are installed on a flat surface between said spaced apart corner ring fixtures to support lengths of fabric material passed through said corner fixture ring elements.

* * * * *